United States Patent [19]

Harrison

[11] Patent Number: 4,584,209

[45] Date of Patent: Apr. 22, 1986

[54] FLOOR COVERING MATERIALS

[75] Inventor: Alan M. Harrison, Welwyn, United Kingdom

[73] Assignee: Welwyn Plastics (1955) Limited, Welwyn North, England

[21] Appl. No.: 688,963

[22] Filed: Jan. 4, 1985

[30] Foreign Application Priority Data

Jan. 6, 1984 [GB] United Kingdom ..... 8400275

[51] Int. Cl.[4] ..... B32B 5/16; B32B 33/00

[52] U.S. Cl. ..... 427/201; 427/202; 427/356; 427/359; 427/372.2; 427/407.3; 428/67; 428/149; 428/172; 428/325; 428/331

[58] Field of Search ..... 428/149, 150, 67, 172, 428/323, 325, 329, 331; 427/201, 202, 359, 372.2, 407.3, 356

[56] References Cited

U.S. PATENT DOCUMENTS

| | | | |
|---|---|---|---|
| 3,499,956 | 3/1970 | Mountain | 428/67 |
| 3,565,661 | 2/1971 | Harrison | 427/356 |
| 4,263,081 | 4/1981 | Scher et al. | 428/172 |
| 4,348,447 | 9/1982 | Miller et al. | 428/149 |
| 4,356,037 | 10/1982 | Novak | 428/325 |

*Primary Examiner*—Paul J. Thibodeau

*Attorney, Agent, or Firm*—Dennison, Meserole, Pollack & Scheiner

[57] ABSTRACT

A method of manufacturing a floor covering which includes the steps of:

(a) mixing grits of at least one abrasive substance, and of a dimension not exceeding 0.7 mm, with a thermoplastic paste;

(b) applying at least one coating of the mixture to a sheet of base material ahead of a doctor knife;

(c) passing the coated sheet under the doctor knife, whereby the coating is levelled;

(d) then sprinkling a mixture of silicon carbide grits and colored quartz aggregate particles, each of a dimension exceeding 0.7 mm, onto the surface of said coating and (e) curing the coated sheet;

(f) the grits applied ahead of the doctor knife being of a dimension which does not exceed half the thickness of the coating as levelled by the doctor knife. Preferably, the coloring of the floor covering is mainly derived from the color of the sprinkled particles of quartz aggregate, and preferably the particles of colored quartz have a dimension not exceeding 1.8 mm. The invention also provides a floor covering when so produced.

5 Claims, No Drawings

FLOOR COVERING MATERIALS

This invention relates to floor coverings comprising a base material in sheet form to which has been applied at least one coating of thermoplastic material. The invention further relates to methods of manufacturing such a floor covering.

In the following description and the appended claims:

(1) By "base material" is meant a material in sheet form which may be hessian, woven cotton fabric felt, paper, metal foil, woven fibreglass or synthetic mesh material which can be supplied in roll form and which is suitable for being coated to provide a wearing surface.

(2) By "thermoplastic material" is meant polyvinylchloride or other synthetic thermoplastics material capable of being cured by heat.

(3) By "grits" is meant small grains having a size of 0.4 to 0.7 mm diameter [or between 30 and 60 mesh (holes per linear inch)].

(4) By "abrasive substance" is meant one or more of the substances normally used for rubbing or grinding surfaces, examples being silica, corundum, emery and carborundum.

(5) By "coloured quartz aggregate particles" is meant quartz aggregate particles having a size between 0.7 mm and 1.8 mm. The particles may be pigmented, the pigment having been fired with the quartz. Or, the particles may be coated with a thin layer of pigmented resin which is stable under the temperature conditions pertaining to the curing of the polyvinylchloride or other curable synthetic plastics material employed.

One method of manufacturing the floor covering according to the invention includes the steps of:

(a) mixing grits of at least one abrasive substance and of a dimension not exceeding 0.7 mm, with a thermoplastic paste:

(b) applying at least one coating of the mixture to a sheet of base material ahead of a doctor knife;

(c) passing the coated sheet under the doctor knife, whereby the coating is levelled:

(d) then sprinkling a mixture of abrasive grits and coloured quartz aggregate particles, each of a dimension exceeding 0.7 mm, onto the surface of said coating and (e) curing the coated sheet:

the grits applied ahead of the doctor knife being of a dimension which does not exceed half the thickness of the coating as levelled by the doctor knife.

Preferably, the colouring of the floor covering is mainly derived from the colour of the sprinkled coloured particles of quartz aggregate.

Advantageously, the abrasive grains and quartz particles are each respectively, in an amount not exceeding 25% of the weight of the floor covering, which latter has a thickness of between 2.0 mm and 4.5 mm.

Where a high quality surface finish is required, the coated sheet must have applied to it at least two coatings of thermoplastic paste impregnated with abrasive grits, the additional coating having the required rheological properties, so that on being passed under the doctor knife, the coated sheet has the correct surface finish to receive the sprinkled mixture of coloured quartz aggregate particles and abrasive grits immediately prior to being cured.

The sprinkled grits preferably include silicon carbide grits, while the abrasive grits which are initially mixed with the paste, are suitably aluminium oxide grits. In practice a grain size of the order of 40 mesh or 0.6 mm has been found satisfactory for these grits. Alternatively, the grits of abrasive substance initially mixed with the paste, may be one or both of aluminium oxide or silicon carbide. Advantageously, the coating contains grits in the amount approximately 20% by weight of the mixture of paste and grits.

While hessian has proved to be a suitable base material for most uses, a tissue of glass fibres is preferred.

The thermoplastic material is preferably a paste of polyvinylchloride. The thermoplastic paste must be of such viscosity that it does not pass through the base material. The paste may be a clear paste with all colouring being provided by the coloured quartz. If the paste is pigmented, its colour must not mask that of the coloured quartz.

In a process according to one preferred embodiment of the invention, P.V.C. paste is prepared in standard type mixing equipment and then transferred to a change pan kneader type mixer for the incorporation of the abrasive grits e.g. of aluminium oxide. The change from a standard mixer to one in which the pan can be changed is due to the abrasive nature of the grits. This P.V.C. paste, now containing abrasive grits, is applied, in one or more coatings, onto a suitable base material and levelled by a doctor knife. A minimum of two coats is usually employed and built up to the necessary thickness.

Immediately after the final coat has been applied, and levelled by the doctor knife, the mixture of coloured quartz aggregate particles and abrasive grits, is sprinkled over the uncured paste. The purpose of these grits is to provide a high percentage of abrasive material near the surface of the flooring. The coated and sprinkled sheet may be passed beneath a finishing roll before entering a curing oven. Curing may be by infra-red radiation.

After the curing of the final coat the material may be embossed with a suitable engraved roller to give any desired surface texture adding to the initial non-slip characteristics of the flooring and more readily permitting the grit to penetrate through the top skin. Once this has cured the very hard aluminium oxide, well bonded to the mass of the P.V.C. is sufficiently exposed to give a flooring with non-slip properties. Silicone carbide, being more brittle than aluminium oxide readily breaks the skin of P.V.C. that forms during the curing operation.

The present invention also provides a floor covering when produced by the method as described above.

The floor covering preferably, has a thickness of between 2.0 mm and 4.5 mm and contains coloured quartz aggregate particles in an amount not exceeding 25% by weight.

When the thermoplastic material has applied to its upper surface before the paste constituting the said upper surface is heat cured, silicon carbide in grit form, this silicon carbide grit is highly reflective of light and it confers an attractive finish to the surface of the floor covering. Moreover, its addition provides a high percentage of abrasive material at the tread surface while, although it is abrasive, it is brittle and breaks through the skin of thermoplastic material which forms as a surface film during the heat curing operation. There results a homogeneous coating to the base material, which maintains its slip resistant properties throughout the working life of the floor covering.

I claim:

1. A method of manufacturing a floor covering, comprising the steps of:

(a) mixing grits of at least one abrasive substance with a thermoplastic paste;

(b) coating said mixture on a base material;

(c) passing the coated base material under a doctor knife to level the coating;

(d) sprinkling a colored quartz aggregate material on the levelled coating surface;

(e) curing the levelled coated base material with said colored quartz aggregate; and (f) repeating said steps (b) through (e) at least once, to produce at least two coating layers;

wherein the maximum dimension of each of said grits does not exceed 0.7 mm and does not exceed half the thickness of the levelled coating layer in which it is contained, and wherein the maximum dimension of each of said colored quartz aggregate is greater than 0.7 mm but less than 1.8 mm;

the total thickness of the floor covering being between 2 and 4.5 mm, and the grits and quartz particles each being present in an amount which does not exceed 25% of the weight of floor covering.

2. A method of manufacturing a floor covering according to claim 1, wherein said colored quartz aggregate material is sprinkled in combination with silicon carbide.

3. A method of manufacturing a floor covering according to claim 1, wherein immediately prior to curing the last of said coating layers, the coated base material is passed beneath a finishing roll.

4. A method of manufacturing a floor covering according to claim 1, wherein the base material is a tissue of glass fibers.

5. A floor covering produced by the method of claim 1.

* * * * *